United States Patent [19]

Overman

[11] 4,396,711

[45] Aug. 2, 1983

[54] SPEED-INCREASING ADJUVANTS FOR SILVER HALIDE EMULSIONS

[75] Inventor: Joseph D. Overman, Wilmington, Del.

[73] Assignee: E. I. Du Pont de Nemours and Company, Wilmington, Del.

[21] Appl. No.: 363,378

[22] Filed: Mar. 29, 1982

[51] Int. Cl.[3] ..... G03C 1/28

[52] U.S. Cl. ..... 430/600; 430/603

[58] Field of Search ..... 430/600, 603, 599, 611, 430/613

[56] References Cited

U.S. PATENT DOCUMENTS 2,860,976 11/1958 Spath ..... 430/379

3,565,625 2/1971 Scavron ..... 430/600

*Primary Examiner*—Won H. Louie, Jr.

[57] ABSTRACT

Derivatives of thiazolidine are used in photographic silver halide emulsions to increase their speed 40% or more with little or no increase in emulsion fog. Lower silver halide coating weights are thus possible.

14 Claims, No Drawings

SPEED-INCREASING ADJUVANTS FOR SILVER HALIDE EMULSIONS

BACKGROUND OF THE INVENTION

1. Field of the Invention

This invention relates to photographic silver halide emulsions, and specifically to derivatives of thiazolidine which can be added to such emulsions, and to photographic films with improved speed prepared from these emulsions.

2. Description of the Prior Art

Thiazolidine compounds have been used in association with photographic elements in the prior art. In particular, L-thiazolidine-4-carboxylic acid (subsequently referred to as TCA)

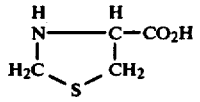

has been used as a fog inhibitor in photographic developer solutions as described by Spath, U.S. Pat. No. 2,860,976. Other prior art references refer to the use of various 4-carboxythiazolidine derivatives as fog inhibitors directly in the photographic emulsion. Scavron, U.S. Pat. No. 3,565,625, claims the use of TCA to sensitize a photographic emulsion by incorporation of the TCA in an auxiliary layer, relying on migration of the TCA to the emulsion layer to cause sensitization. This process, however, has inherent draw-backs. It is difficult to predict the amount of TCA that will migrate into the emulsion, and thus over- or under-sensitization may occur. When TCA is added directly to the emulsion it sometimes causes desensitization and/or fog. Thus, it is desirable to find silver halide emulsion sensitizers capable of producing predictably high speed photographic film.

SUMMARY OF THE INVENTION

In accordance with the teachings of this invention there is provided a photographic film comprising (1) a support, and (2) a radiation-sensitive, colloid-silver halide emulsion layer containing a sensitizing amount of a compound selected from the group consisting of

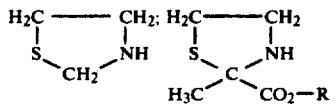

wherein R is an alkyl of 1–4 carbon atoms;

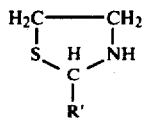

wherein R′ is a member of the group consisting of

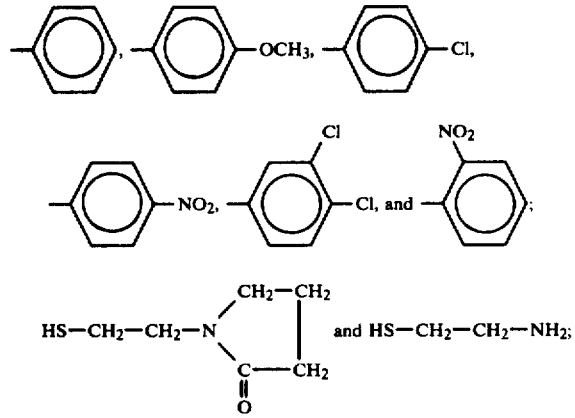

and the hydrochloride salts thereof.

Photographic silver halide films prepared from emulsions of this invention exhibit increased sensitivity compared to films prepared without the above described sensitizing components, which makes it possible to prepare photographic film of equivalent sensitivity with less silver halide coating weight by incorporating therein the sensitizing components of this invention. Such components can increase the speed of an X-ray emulsion up to 40% without increasing fog.

DETAILED DESCRIPTION OF THE INVENTION

The sensitizing compounds of this invention may be used to sensitize any of the common gelatino-silver halide emulsions, e.g., silver bromide, chloride, iodide or mixtures thereof. These compounds may be added to the emulsion from suitable solvents (e.g., water, acetone, ethanol, etc. or mixtures thereof). For example, the HCl salts may be conveniently dispersed in water, while some other species may require organic solvents. Preferably, solvents miscible with water are used because of the aqueous nature of gelatino-silver halide emulsions.

The compounds are normally added to an emulsion as an after-addition just prior to coating on a suitable film support. They are added in amounts of 3 mg to 300 mg per 1.5 moles of silver halide (known as a "unit of emulsion"). The amount of sensitizer used depends on the particular species. An optimum range of preferred compounds is 6 mg–40 mg/unit of emulsion.

The emulsion may also be sensitized with other commonly used emulsion sensitizers such as gold, sulfur, and polyethylene oxide. The emulsion may also contain wetting agents, hardeners, antifoggants, dyes, and other common adjuvants. Commonly used binders (e.g., gelatin, hydrolysed PVA, etc.) may be efficaciously used in the making of the emulsions of this invention also.

The sensitized emulsion of this invention may be coated on any of the commonly used film supports such as polyethylene terephthalate, cellulosic films, etc. The preferred support is polyethylene terephthalate film, suitable subbed (subcoated) as described in the prior art.

This invention is illustrated by the following examples of which Examples 1 and 2 are considered to be the best mode:

EXAMPLE 1

A gelatino-AgIBr emulsion (ca. 98 mole % AgBr/2 mole % Ag I) was made according to Example 1 of Schoenberg, U.S. Ser. No. 257,972 filed Apr. 27, 1981, pages 7, line 30, through page 9, line 24, which disclosure is herewith incorporated by reference. Two emulsion samples were prepared. The first sample was coated as a control on a polyethylene terephthalate film support, suitably subbed. To the other sample was added 0.0033 g./mole of silver halide of the following compound, dissolved in water:

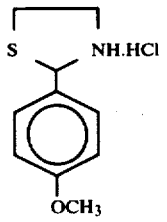

This emulsion was then coated on a polyethylene terephthalate film support as previously described. Both samples were coated to a thickness of 80 mg/dm$^2$ as silver bromide. Sample strips from each coating were then exposed through a $\sqrt{2}$ step wedge for $10^{-2}$ seconds on a Mark 6 Sensitometer produced by E.G. and G. Co. (GE Type FT-118 Xenon Flash Tube) containing a 1.0 neutral density filter and a No. 207763, $10^{-2}$ compensating attenuator grid. The exposed strips were then developed for 3 min. at room temperature in a standard X-ray type developer (Phenidone-hydroquinone) and the following results obtained:

| Sample | Relative Speed | Contrast | Fog |
|---|---|---|---|
| 1-Control | 100 | 1.5 | 0.03 |
| 2-Of this invention | 141 | 1.3 | 0.05 |

EXAMPLE 2

A gelatino-silver halide emulsion made according to the teachings of Example 1 was split into three samples. Sample 1 (the Control) was coated as is without further addition. To samples 2 and 3 were added varying amounts of the following compound dissolved in water:

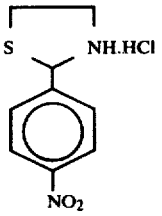

These samples were also coated, and sample strips exposed and developed as described in Example 1; with the following results:

| Sample | Relative Speed | Contrast | Fog |
|---|---|---|---|
| 1-Control | 100 | 1.3 | 0.02 |
| 2-.0053g/mol. Agx | 123 | 1.2 | 0.02 |
| 3-.0107g/mol. Agx | 141 | 1.2 | 0.04 |

EXAMPLE 3

An emulsion made according to the teachings of Example 1 was split into two portions. Sample 1 (the Control) was coated as is without further treatment. Sample 2 (the Invention) further contained 0.002 g/mole of silver halide of HS—$CH_2$—$CH_2$—$NH_2$.HCl dissolved in water. Sample 2 was also coated on a suitable film support as previously described. Strips from each coating were then exposed and developed per Example 1 with the following results:

| Sample[1] | Relative Speed | Contrast | Fog |
|---|---|---|---|
| 1-Control | 100 | 1.7 | 0.02 |
| 2-with 0.002 g/mole AgX of HS—$CH_2$—$CH_2$—$NH_2$.HCl | 132 | 1.6 | 0.02 |

[1]Film strip developed for 1.5 min. at room temperature in the developer of Ex. 1.

EXAMPLE 4

A high speed, industrial X-ray emulsion comprising ca. 98.8% silver bromide and ca. 1.2% silver iodide with average grain size of about 0.7-0.8μ, and containing about 160 g of gelatin/1.5 mole of silver halide, was sensitized with organic sulfur and aurous thiocyanate and contained the usual antifoggants, wetting agents, coating aids, and the like. The emulsion was split into five (5) samples. One sample was coated as is for control purposes. Two other samples contained varying amounts of compound A, below, and the final two samples varying amounts of compound B, below:

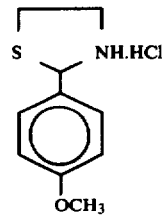

Compound A (in water)

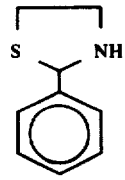

Compound B (in ethanol)

All samples were coated on polyethylene terephthalate film supports as previously described. Strips from each coating were exposed as previously described (Ex. 1) and developed 3 min. at ambient temperature in the developer of Example 1 with the following results:

| Sample | Amt. Used (g/mole AgX) | Rel. Speed | Contrast | Fog |
|---|---|---|---|---|
| 1 | Control - None | 100 | 1.2 | 0.02 |
| 2 | 0.055 Compound A | 157 | 1.2 | 0.02 |
| 3 | 0.11 Compound A | 192 | 1.2 | 0.04 |
| 4 | 0.055 Compound B | 157 | 1.3 | 0.03 |
| 5 | 0.11 Compound B | 168 | 1.2 | 0.08 |

EXAMPLE 5

An emulsion similar to that described in Example 4 was prepared and split into 5 samples. One sample was used as control. Two others were treated with varying amounts of Compound C, below, and two other with varying amounts of Compound D, below:

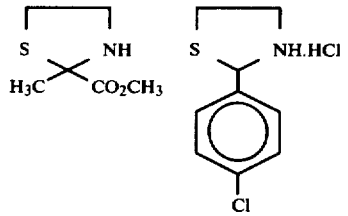

Compound C (in ethanol) Compound D (in $H_2O$)

All samples were coated on film supports, exposed and developed as described in Example 4 with the following results:

| Sample | Amt. Used (g/mole AgX) | Rel. Speed | Contrast | Fog |
|---|---|---|---|---|
| 1 | Control - None | 100 | 1.4 | 0.08 |
| 2 | 0.064 Compound C | 123 | 1.3 | 0.05 |
| 3 | 0.096 Compound C | 186 | 1.7 | 0.11 |
| 4 | 0.027 Compound D | 162 | 1.7 | 0.09 |
| 5 | 0.054 Compound D | 200 | 1.9 | 0.12 |

EXAMPLE 6

An emulsion made according to Example 4 was split into three samples. One sample was used as a control while varying amounts of

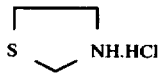

in water were added to the other two samples. All samples were coated, exposed, and developed in a Metol-hydroquinone developer for 1.5 min. with the following results:

| Sample | Amt. Used (g/mole AgX) | Rel. Speed | Contrast | Fog |
|---|---|---|---|---|
| 1 | Control - None | 100 | 1.1 | 0.01 |
| 2 | 0.004 | 141 | 1.0 | 0.02 |
| 3 | 0.008 | 174 | 1.1 | 0.03 |

EXAMPLE 7

Example 6 was repeated but using varying amounts of the following compound:

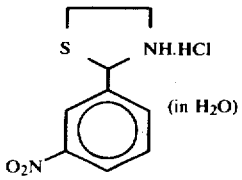

The following results were achieved:

| Sample | Amt. Used (g/mole AgX) | Rel. Speed | Contrast | Fog |
|---|---|---|---|---|
| 1 | None - Control | 100 | 1.0 | 0.01 |
| 2 | 0.033 | 123 | 1.0 | 0.01 |
| 3 | 0.05 | 141 | 1.1 | 0.01 |

EXAMPLE 8

An emulsion made according to the teachings of Example 4 was split into seven (7) samples. One sample was kept as a control. The others were treated with varying amounts of the following compounds:

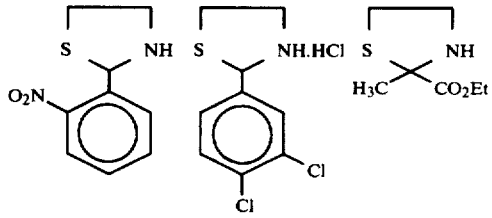

Compound E (in ethanol) Compound F (in $H_2O$) Compound G (in ethanol)

The samples were all coated, exposed and developed in a Metol-hydroquinone developer for 1.5 min. with the following results:

| Sample | Amt. Used (g/mole AgX) | Rel. Speed | Contrast | Fog |
|---|---|---|---|---|
| 1 | Control - None | 100 | 1.2 | 0.01 |
| 2 | 0.09 Compound E | 141 | 1.1 | 0.01 |
| 3 | 0.12 Compound E | 152 | 1.1 | 0.05 |
| 4 | 0.09 Compound F | 174 | 1.0 | 0.02 |
| 5 | 0.12 Compound F | 187 | 1.2 | 0.05 |
| 6 | 0.075 Compound G | 174 | 1.0 | 0.02 |
| 7 | 0.106 Compound G | 174 | 1.0 | 0.03 |

EXAMPLE 9

An emulsion prepared according to the teachings of Example 1 was split into three (3) samples. Sample 1, the Control, was coated on a film support without further treatment. Samples 2 and 3 contained varying amounts of prior art adjuvant TCA (dissolved in $H_2O$). Samples 2 and 3 were coated on a film support at coating weights of about 40 mg silver bromide/$dm^2$. Each sample was exposed as described in Example 1 and developed for about 2.5 min. at ambient temperature in the same developer, with the following results:

| Sample | Amt. TCA Used (mg/mole AgX) | Rel. Speed | Base + Fog |
|---|---|---|---|
| 1 | None - Control | 100 | 0.01 |
| 2 | 106 | 100 | 0.02 |
| 3 | 185 | 87 | 0.05 |

As can be easily seen, the prior art adjuvant results do not compare to those achieved by using the derivatives of thiazolidine as taught in this invention.

EXAMPLE 10

An emulsion made according to the teachings of Example 1 was split into three (3) samples. Sample 1

(the Control) was coated on a subbed film support without further treatment. To Samples 2 and 3 were added varying amounts of N-(2-mercaptoethyl)-2-pyrrolidone (MEP)

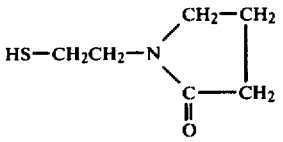

(dissolved in water). Both samples were coated on supports as previously described. The coating weights were about 60 mg silver bromide/dm$^2$. Each sample was exposed as described in Example 1 followed by a 2½ min. development in the same developer described therein. After fixing, washing and drying, the sensitometry was as follows:

| Sample | Amt. MEP Used (mg/mole AgX) | Rel. Speed | Contrast | Base + Fog |
|---|---|---|---|---|
| 1 | None - Control | 100 | 1.1 | 0.01 |
| 2 | 16 | 115 | 1.1 | 0.02 |
| 3 | 56 | 132 | 1.0 | 0.04 |

I claim:

1. A photographic film comprising (1) a support, and (2) a radiation-sensitive, colloid-silver halide emulsion layer containing a sensitizing amount of a compound selected from the group consisting of

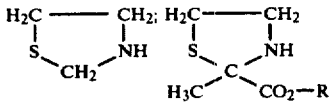

wherein R is an alkyl of 1–4 carbon atoms;

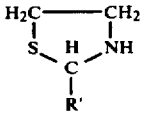

wherein R' is a member of the group consisting of

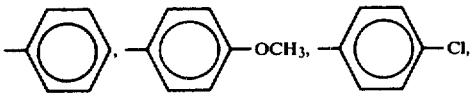

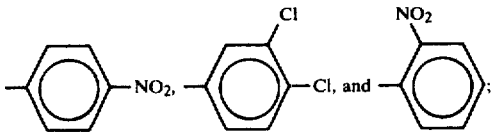

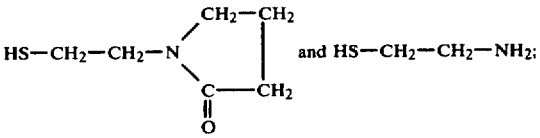

and the hydrochloride salts thereof.

2. The photographic film of claim 1 wherein said compound is present in the silver halide emulsion in an amount of 5–30 mg per 1.5 moles of silver halide.

3. The photographic film of claim 1 wherein said compound has the formula

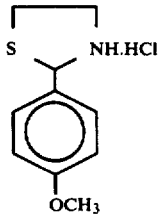

4. The photographic film of claim 1 wherein said compound has the formula

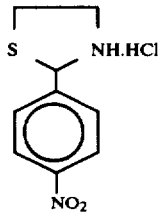

5. The photographic film of claim 1 wherein said compound has the formula $HS—CH_2—CH_2—NH_2.HCl$.

6. The photographic film of claim 1 wherein said compound has the formula

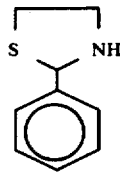

7. The photographic film of claim 1 wherein said compound has the formula

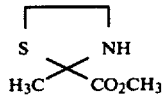

8. The photographic film of claim 1 wherein said compound has the formula

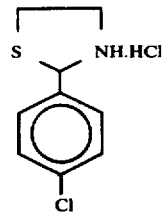

9. The photographic film of claim 1 wherein said compound has the formula

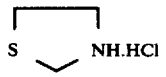

10. The photographic film of claim 1 wherein said compound has the formula

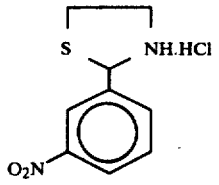

11. The photographic film of claim 1 wherein said compound has the formula

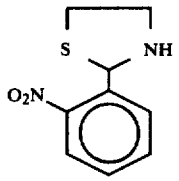

12. The photographic film of claim 1 wherein said compound has the formula

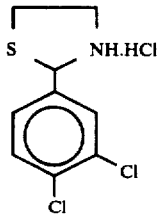

13. The photographic film of claim 1 wherein said compound has the formula

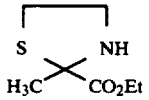

14. The photographic film of claim 1 wherein said compound has the formula

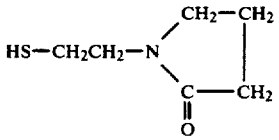

* * * * *